US006491564B1

(12) United States Patent
Miller

(10) Patent No.: US 6,491,564 B1
(45) Date of Patent: Dec. 10, 2002

(54) VOICE AMPLIFIER TOY

(76) Inventor: Lauren F. Miller, 3015 Campbell St., K.C., MO (US) 64109

( * ) Notice: Subject to any disclaimer, the term of this patent is extended or adjusted under 35 U.S.C. 154(b) by 0 days.

(21) Appl. No.: 09/992,759

(22) Filed: Nov. 6, 2001

(51) Int. Cl.[7] ..... A63H 33/40
(52) U.S. Cl. ..... 446/202; 446/207
(58) Field of Search ..... 446/202–207, 446/408, 416, 200; 84/402, 410, 408–409, 386, 330

(56) References Cited

U.S. PATENT DOCUMENTS

| | | | | |
|---|---|---|---|---|
| 552,612 | A | | 1/1896 | Frost |
| 700,986 | A | | 5/1902 | Smith |
| 1,354,959 | A | | 10/1920 | Debs |
| 2,006,732 | A | | 7/1935 | Cohn |
| 2,559,124 | A | | 7/1951 | Kerner |
| 2,700,316 | A | * | 1/1955 | Gordon et al. |
| 3,484,799 | A | * | 12/1969 | Sioles et al. |
| 3,814,050 | A | * | 6/1974 | Warnod |
| 4,799,913 | A | * | 1/1989 | Wolfe ..... 446/193 |
| 5,803,785 | A | * | 9/1998 | Primos, Jr. et al. ..... 446/207 |
| 6,083,075 | A | * | 7/2000 | Meeks ..... 446/207 |
| 6,254,451 | B1 | * | 7/2001 | Bean ..... 446/207 |

* cited by examiner

*Primary Examiner*—Derris H. Banks
*Assistant Examiner*—Jamila Williams
(74) *Attorney, Agent, or Firm*—Chase Law Firm, L.C.

(57) ABSTRACT

An improved kazoo includes a cylindrical input pipe in communication with a downstream plenum for conveying air from the plenum and against a diaphragm traversing the air path. An end cap is secured to the downstream pipe with the diaphragm therebetween. Vents in the end cap expose one side of the diaphragm to the ambient air. An outlet pipe with nuance aperture therein presents an outlet aperture for conveying the back air pressure from the plenum to the ambient air. The kazoo is configured to be encompassed by the user's cupped hands which allows the user to present a mouthpiece in the form of a user's thumb and index finger encircling the input pipe. The size of the inlet, vent, nuance and outlet apertures is controlled by the user's palm and fingers. The controlled size of each aperture allows the user to modulate the aural characteristics of the kazoo sound produced by user air forced into the input pipe aperture.

25 Claims, 2 Drawing Sheets

4"
(when assembled)
1 3/4"
1 1/2"
3 1/2"

10
11
12
20
21
22
24
30
31
33
35
36
37
60
62
63
64
65
66
80
81
82
83
84
86
100

VOICE AMPLIFIER TOY

BACKGROUND OF THE INVENTION

This invention pertains generally to the field of voice amplifier toys and, more particularly, to an improved kazoo having structure for providing improved sound qualities and control thereof.

The basic kazoo is known in the art. Generally, the kazoo sound arises from the user forcing air through a tube and across a membrane with the vibration of the membrane causing the kazoo sound or "kaz". The air is produced by the user's vocal input, e.g., humming, singing, etc., into the input end of the kazoo. The elongated tube of the kazoo affects the tone quality but not the pitch. Typically, the membrane is a thin piece of cellophane, waxed paper or plastic film stretched across an aperture and held in place by a cardboard ring. The user-generated airwaves vibrate this membrane/diaphragm and produce the familiar kazoo sound.

The sound of a kazoo is a direct and unmodulated one, which tends to be aurally displeasing. As the configuration of prior kazoos is not conducive to control by the user's fingers and/or hands, the output is altered only by variations in pitch and volume of the user's vocal input resulting in a direct, unmodulated kazoo sound lacking any tonal nuances.

Thus, it is desirable to be able to improve the control/modulation of the kazoo sound and the player's access thereto.

In response thereto I have invented a kazoo with an input tube, downstream plenum, a downstream output tube with diaphragm presenting an end for receiving an adjustable apertured cap and a supplementary plenum outlet tube with outlet aperture. The overall structure of my kazoo enables the kazoo to fit into the cupped hands of a user which allows the user to regulate the size of the various apertures with the palms and/or fingers of the hands. Thus, my kazoo sound can be modulated by regulating and/or varying the amount of air back pressure within the instrument; by controlling the amount of air entering the instrument and by controlling the vibrations of the diaphragm responsive to the input air.

It is therefore a general object of this invention to provide an improved kazoo.

Another object of this invention is to provide a kazoo, as aforesaid, which enables the user to control/modulate the kazoo sound.

A further object of this invention is to provide a kazoo, as aforesaid, which enables the user to control the proportion of vocal sound entering the kazoo.

Another object of this invention is to provide a kazoo, as aforesaid, which enables the user to control the air pressure buildup in the kazoo.

A particular object of this invention is to provide a kazoo, as aforesaid, which enables the user to control the vibration of the kazoo diaphragm therein.

Another particular object of the invention is to provide a kazoo, as aforesaid, which enables the user to control the output air discharged from the kazoo.

A further particular object of this invention is to provide a kazoo, as aforesaid, which presents at least one aperture in the kazoo body which enables the user to further nuance the produced kazoo sound.

Still a further particular object of this invention is to provide a kazoo, as aforesaid, which is adapted to be controlled by the encompassed hands of the user.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figures 1, 2, 3:
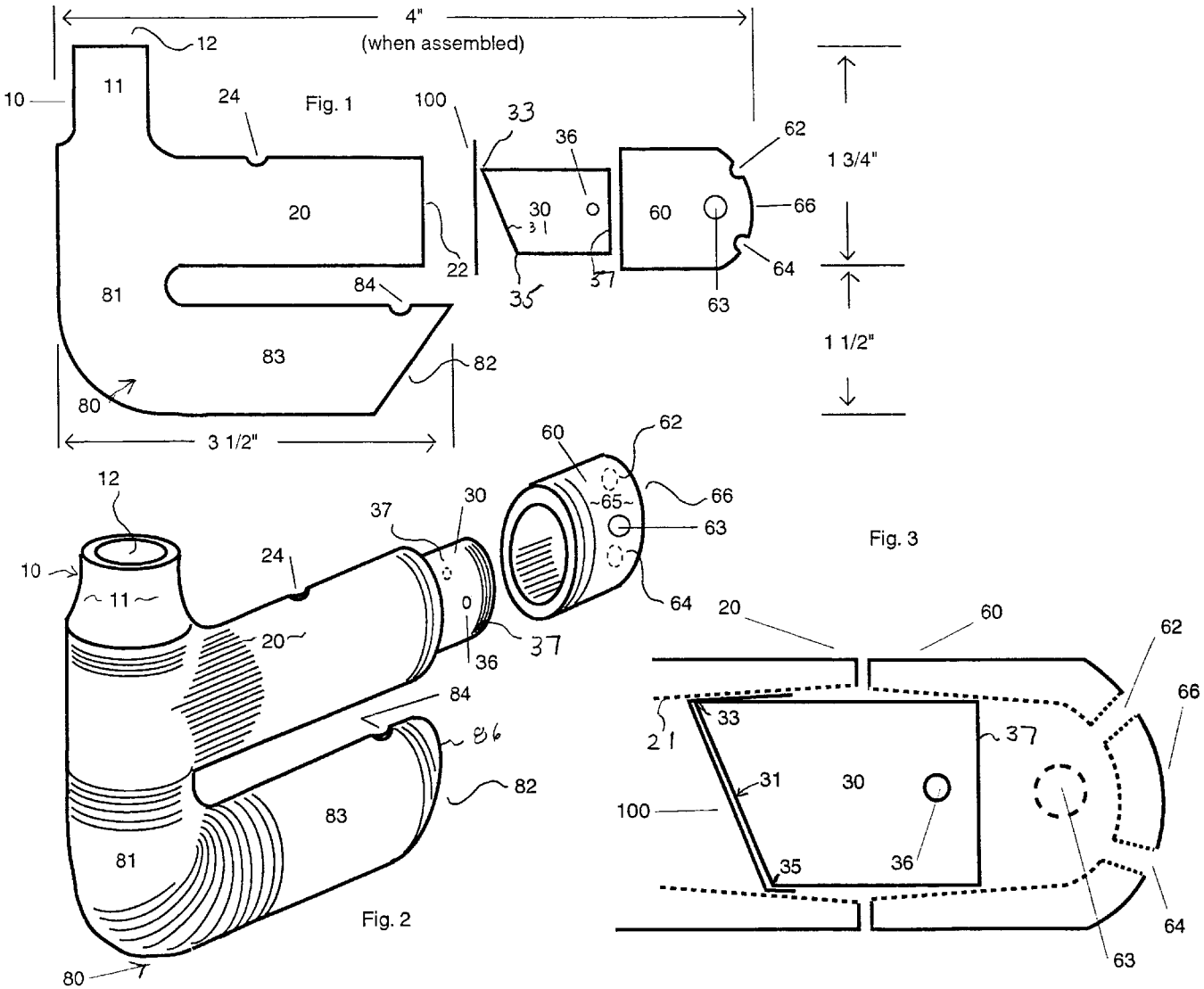
FIG. 1 is a diagrammatic plan view showing various exploded elements of my first kazoo.
FIG. 2 is a perspective view of my first kazoo embodiment with the cap exploded therefrom.
FIG. 3 is a diagrammatic view, on an enlarged scale, showing the plenum end with the diaphragm/tube combination therein and the end cap secured thereto.

FIGS. 1–3 diagrammatically shows the various elements of a now preferred embodiment of my kazoo. (The overall dimensions thereon are not limitations of my invention.) As shown, the kazoo comprises an input tube 10 having input aperture 12 through which the user forces air. The exterior surface 11 of the input tube 10 presents a surface for seating the user's thumb and forefinger therearound.

Downstream of the input tube 10 is a right angled plenum 20 having an increased internal cross-sectional area relative to the volume of the input tube 10. This plenum 20 provides a chamber for creation of back pressure and on the facing surface of a downstream diaphragm 100.

A first end 31 of a tube 30 is covered by a diaphragm 100 for penetration into the aperture 22 of plenum 20. The inside diameter of the plenum 20 bore tapers from the downstream end 22 (FIG. 3). The upstream end 31 of tube 30 is beveled (20°) to present leading 33 and trailing 35 edges. Upon insertion of tube 30 into downstream aperture 22 of plenum 20, the leading edge 33 of tube 30 bears against the diminishing inside diameter of the plenum 30 before the trailing edge 35. Thus, diaphragm 100, spanning the aperture in the upstream end 31 of the plenum 20, will be pinched tighter against the wall 21 of the plenum 20 bore than at the trailing edge 35. This relationship presents slack within the diaphragm 100 which aids vibration. Tube 30 is rotatably inserted within the plenum 20. A nail (not shown), releasably inserted through diametrically opposed holes 36, 37 in the tube 30, presents a handle for user manipulation and rotation.

The downstream end 37 of tube 30 extends beyond the downstream end 22 of plenum 20. A cap 60 is secured about the downstream end 37 of tube 30. The cap 60 includes one or more apertures 62, 64 in the end surface 66 of the cap and an additional aperture 63 in the side surface all vented to atmosphere. Upon positioning cap 60 on tube 30, the apertures 62, 63, 64 are within reach by one or more fingers of the player. The end 66 of the secured cap, as displaced from the diaphragm 100, presents a resonance chamber therebetween.

The apertures 62, 63, 64 (≈1/8") controls the "kaz" sound within the resonance chamber. The greater the area of these apertures the less resonance. A smaller total area will reduce/muffle the kazoo sound. Aperture 63 is displaced from apertures 62 and 64 to decrease the likelihood that all these apertures 62, 63, 64 might inadvertently be closed simultaneously by a user's fingers.

A second outlet tube 80 communicates with input tube 12 and plenum 20 via portion 81 and a right angled portion 83 parallel to plenum 20. The downstream end 86 of portion 83 is beveled to allow separate fingers of the player's right hand to comfortably cover both aperture 82 and the front surface of cap 60. In the tube 80 portion 83 is a second outlet aperture 84 of relatively small size compared to aperture 82. This aperture 84 provides for a continuous airflow through the tube portion 83 even if aperture 82 is completely closed.

The overall size of the kazoo is chosen so that it can be enveloped by the cupped hands of a user. In use, the thumb and forefingers of the cupped left hand of the user encircles the cylindrical seat 11 about the input pipe 10. These fingers present a circular mouthpiece intermediate the player's lips and aperture 12. As the user's lips are pressed against this finger-formed mouthpiece, the percentage of air entering the inlet aperture 12 is controlled according to the degree of pressure of the fingers about seat 11. A lesser pressure presents a looser/slacker mouthpiece which allows more air to bypass the input aperture 12.

A lighter pressure of the fingers about seat 11 decreases the percentage of user air directed into the input aperture 12. This permits a player to produce a note requiring a higher vocal pressure (e.g., a high note) without introducing this higher pressure (and its resultant louder sound) into the kazoo.

The user's lips can assume a wide range of tone-relevant shapes (such as orotund for hollow tones, compressed for reedier ones) while transferring vocal output through the digitally formed mouthpiece and into the kazoo input pipe 10. Variations in the position and/or pressure of the mouth against the mouthpiece can produce vibrato or tremolo effects. The cupped hands of the user about the kazoo present a surrounding resonance chamber, the volume of which can be varied so as to modulate the produced tone. A variance in the cupped hands, e.g., from spherical to flat, varies the volume of this chamber. Similarly, varying the hand pressure forming this chamber modulates the tone by altering the extent to which sounds entering this hand chamber escape to the outside air.

During play the size of the outlet aperture 82 can be varied by the palm or fingers of the user's right hand which regulates the volume of exhausted air. In turn the back pressure within the plenum 20 and the pressure against one side of the diaphragm 100 is regulated. The vibration of diaphragm 100 is thus controlled as well as the amount of air discharged from aperture 82 into the hand chamber. This structure further enables a user to modulate the kazoo sound.

Rotation of tube 30 within plenum 30 unevenly tensions the diaphragm 100 due to the leading 33 and trailing 35 edges as manifested by wrinkles in diaphragm 100. The more wrinkled the diaphragm 100 the less uniform the diaphragm tension. A more wrinkled diaphragm 100 will vibrate under a lesser input pressure and present a noisier/fluttering sound as opposed to a smoother/uniformly tensioned diaphragm 100 requiring a relatively greater input pressure for vibration which produces a relatively purer tone. Thus, the tone quality of my improved kazoo can also be adjusted by rotation of tube 30 within plenum 20.

Vocal input of the user determines the pitch of successive notes. Articulation of notes is the manner of transition from one note to the next. The transition may be a smooth one, i.e., legato, or separate, i.e., staccato. A change in the internal pressure of the kazoo produces an audible difference in the tonal quality of the kazoo sound. This quality change with the change of pitch can produce an audible separation between notes. Such a subtle but significant change can also be produced by tapping a nuance aperture 24 located in the upper surface of plenum 20 with the middle finger of the left hand. Nuance can also be provided by tapping the outlet aperture 82 with the palm of the right hand.

Furthermore, the cap apertures 62, 63, 64 allow the player to further modulate the tone. As the size of the various apertures can be controlled, a variable range of tonal qualities in the kazoo sound similar to the effect of a mute used in a trumpet can be produced. Articulation can also be provided by tapping these apertures.

Figure 4:
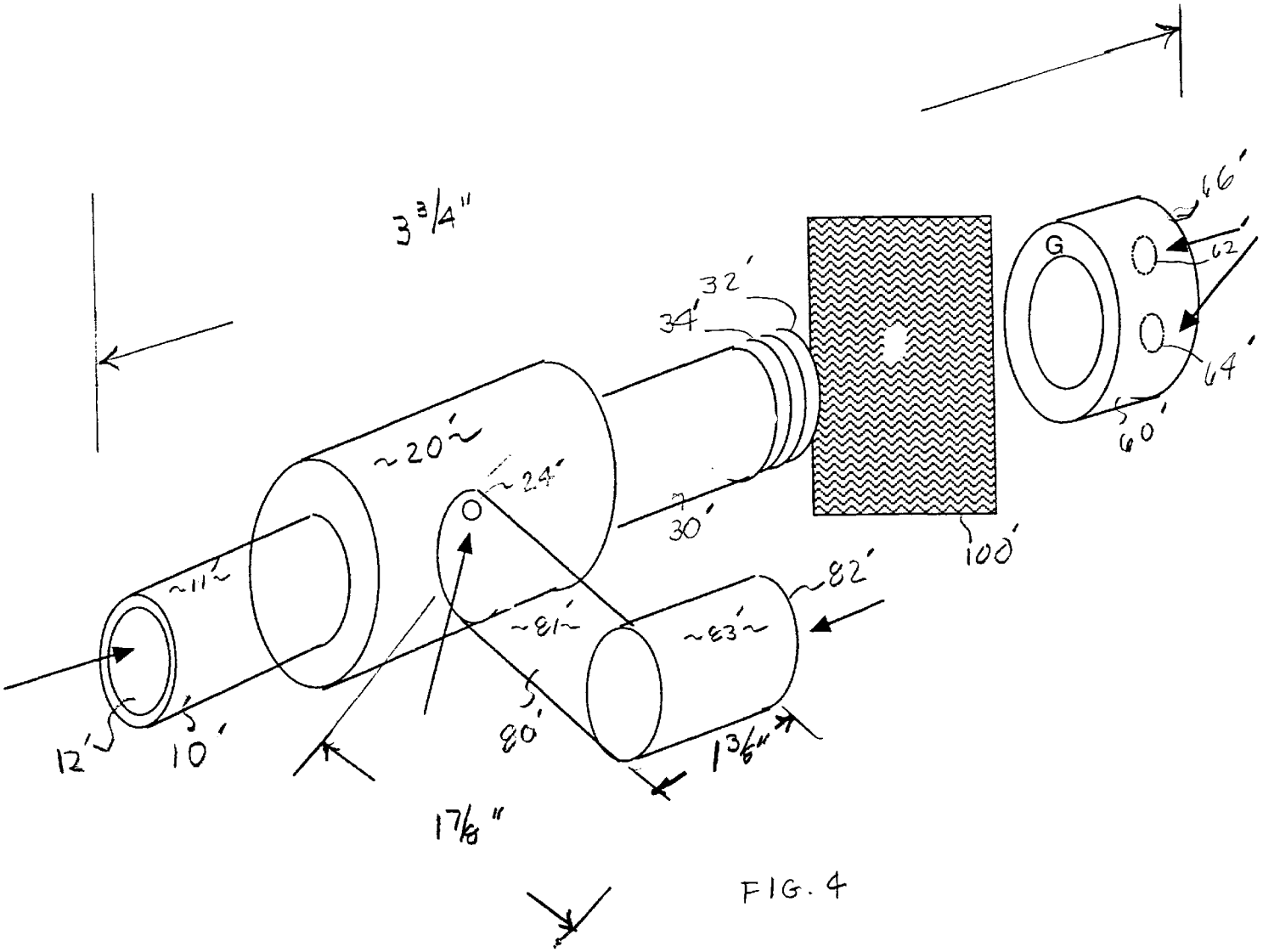
FIG. 4 is a perspective view of a second embodiment of my kazoo.

FIG. 4 diagrammatically shows the various elements of a second alternative embodiment of my kazoo. (The overall dimensions thereon are not limitations of my invention.) Structure corresponding to the above embodiment has been designated with a corresponding primed number. As shown, the kazoo comprises an input tube 10' having an input aperture 12' through which the user forces air. The exterior surface 11' of the input pipe 10' presents a surface for seating the user's thumb and forefinger therearound.

Downstream of the input pipe 10' is a plenum 20' having an increased cross-sectional area relative to the volume of the input pipe 10'. This plenum 20' provides a chamber for creation of back pressure therein and on the facing surface of the downstream diaphragm 100'.

A cap 60' is threadably secured about the threaded end of tube 30' with the intermediate diaphragm 100' therebetween. The cap 60' includes apertures 62', 64' in the end surface 66' vented to atmosphere. The size of these apertures 62', 64' must not expose the diaphragm to excessive outside air pressure acting on the surface of diaphragm 100' opposite the surface exposed to the plenum 20' air. If so, the diaphragm 100' will improperly vibrate and produce an undesirable sound. The end surface 60' of the secured cap 60' is displaced from the diaphragm 100' which creates a resonance chamber between the stretched diaphragm 100' and the cap end surface 66'. By tightening or loosening this cap 60' the tension of the diaphragm, as stretched across the output aperture 32' of the tube 30', is adjusted as well as the size of this resonance chamber. Both of these factors will affect the produced sound.

A second reduced outlet tube 80' with aperture 82' extends from plenum 20'. This tube presents right-angled portions 81', 83' with an outlet aperture 82' displaced from the cap end 66'. This configuration enables the entire kazoo instrument to be encompassed by the user's cupped hands.

As above, the overall size of the kazoo is chosen so that it can be enveloped by the cupped hands of a user. In use, the thumb and forefinger of the cupped left hand of the user encircles the cylindrical surface 11' of the input pipe 10' so as to present a mouthpiece. The tension of these digits encircling about surface 11' can be varied to achieve results as above described.

Again, the cupped hands of the user present a surrounding hand chamber which can be varied and thus enhances the tone of the frequencies produced by my kazoo, particularly the lower frequencies as above described. The degree of intensity of the cupped hands varies the degree of volume of this hand chamber. Thus the amount of sound waves which enters this hand chamber and escapes to the outside air can be varied. Also, the above-described "blowby" (air bypassing the input aperture) entering this hand chamber will mix with the sounds therein to further modulate the produced sound.

During play the size of the outlet aperture 82' can be varied by the palm of the user's right hand. Thus, the user can regulate the back pressure within the plenum 20' which in turn controls the pressure against one side of diaphragm 100'. In turn, the vibration of diaphragm 100' is controlled as well as the amount of air which is discharged from aperture 82' into the hand chamber. This structure further enables the user to modulate the kaz sound.

The tension of the diaphragm 100' can be adjusted by tightening or loosening the cap 60' about aperture 32'. The diaphragm 100' can be easily changed and/or replaced if ruptured, damaged, etc. A looser diaphragm 100' will vibrate under less input pressure and produce a noisier or fluttering sound as opposed to a tighter diaphragm 100'. The tighter diaphragm 100', requiring a relatively greater input pressure for vibration, produces a relatively purer tone. Thus, the tone quality on my improved kazoo can be modulated. Also, this end cap 60'/tube 30' structure adjusts the volume of the resonance chamber which further modulates the sound, particularly at lower frequencies.

Articulation, as above described, can be changed with my alternative kazoo. A subtle change can be produced by tapping with the middle finger of the left hand a nuance aperture 24' found at the juncture of the plenum 20' and outlet tube 80'. Nuance can also be provided by tapping the outlet aperture 82' with the palm of the right hand.

Furthermore, the cap apertures 62', 64' allow the player to further modulate the tone. The sizes of the apertures can be controlled by the user's fingers so as to vary the ambient air pressure and thus the variable resonance chamber pressure acting on the diaphragm 100'. A variable range of tonal qualities in the kazoo sound similar to the effect of a mute used on a trumpet can be produced. Articulation can also be provided by tapping these apertures.

Accordingly, my above-described kazoos allow a player a plurality of options for modulation/control of the kazoo sound. Basically, the improved sound of my kazoos result from the various structures as above-described used in all possible combinations. Such control and accompanying structure cannot be found in a conventional kazoo.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. An amplifier instrument comprising:

an input chamber presenting an input aperture adapted for entry of user forced air therein;

a downstream plenum in communication with said input chamber, a downstream housing presenting a chamber in communication with said plenum, said downstream housing chamber presenting a first end and a second open end extending beyond said plenum;

a diaphragm stretched across said first end of said downstream housing chamber;

a cap engaging said second end of said downstream housing chamber, said cap having a downstream end presenting a chamber between said diaphragm and said downstream cap end;

an aperture in said cap for communicating said diaphragm to air;

an outlet housing in air communication with said input chamber, said outlet housing offset from an air path between said input chamber and said downstream housing, and presenting a chamber with a first outlet aperture adapted for discharge of a portion of the user forced air therethrough, the user forced air entering said input aperture vibrating said downstream diaphragm to produce a sound, a size of said input, outlet and cap apertures regulated by the hand or fingers of a user for influencing the aural characteristics of the sound produced by said vibrating of said downstream diaphragm.

2. The amplifier as claimed in claim 1 further comprising a second aperture in said outlet chamber for a continuous flow of air therethrough.

3. The amplifier as claimed in claim 1 wherein said input chamber presents a surface adapted to be encompassed by a user's index finger and thumb to present a constructive mouthpiece to a user.

4. The amplifier as claimed in claim 1 wherein said input chamber surface presents a surface adapted to be encompassed by a user's index finger and thumb to present a constructive mouthpiece to a user, said surface enabling a tension of the finger and thumb about said input chamber surface to be selectably chosen by a user, whereby to regulate an amount of said user forced air entering said constructive mouthpiece and into said input aperture.

5. The amplifier as claimed in claim 1 wherein said plenum presents a greater volume relative to said input and downstream housing chambers.

6. The amplifier as claimed in claim 1 wherein a size of said amplifier is configured to be enveloped by a pair of cupped hands of a user.

7. The amplifier as claimed in claim 1 wherein said cap is adjustable about said downstream housing chamber second open end, an adjustment of said cap positioning said cap aperture at a desired position relative to said diaphragm of said downstream housing chamber.

8. The amplifier as claimed in claim 1 wherein said downstream housing is releasably engageable with said plenum, said diaphragm stretched across said first end of said downstream housing chamber, an insertion of said downstream housing into said plenum tensioning said diaphragm spanning said first end of said downstream housing chamber.

9. The amplifier as claimed in claim 1 wherein said cap extends beyond said first outlet aperture of said outlet.

10. The amplifier as claimed in claim 1 further comprising a normally open aperture in said plenum, said aperture adapted for selectably closing by a finger of the user, said opening and closing influencing the aural characteristics of the sound produced by said vibrating of said downstream diaphragm.

11. A voice amplifier instrument comprising:

an input chamber presenting an input aperture adapted for entry of forced air produced by a user therein;

a downstream plenum in communication with said input chamber;

a diaphragm having first and second opposed surfaces;

means for communicating a first surface of said diaphragm with air passing through said plenum;

a cap downstream of said diaphragm, said cap having a surface displaced from said second diaphragm surface for presenting a resonance chamber between said second diaphragm surface and said cap surface;

at least one aperture in said cap to communicate said resonance chamber with ambient air;

a discrete outlet chamber in air communication with said input chamber, said outlet chamber offset from an air path between said input chamber and downstream plenum, said outlet chamber having at least one outlet aperture for discharge of air entering said outlet chamber from said input chamber therethrough;

an aperture in said plenum for discharge of air in said plenum therethrough, a user-produced air entering said input aperture vibrating said diaphragm to produce a sound, the size of said input, plenum, at least one outlet aperture and at least one cap aperture influencing the aural characteristics of said produced sound.

12. The amplifier as claimed in claim 12 wherein said size of said input, plenum and at least one outlet and at least one cap apertures is adapted to be controlled by the hands or fingers, or both, of the user.

13. The amplifier as claimed in claim 12 further comprising a normally open aperture in said plenum, said aperture adapted for selectable closing by a finger of the user, said opening and closing influencing the aural characteristics of the sound produced by said vibrating of said downstream diaphragm.

14. An amplifier instrument comprising:

an input pipe presenting an input aperture adapted for entry of forced air produced by a user therein;

a downstream plenum in communication with said input pipe;

a first downstream pipe in communication with said plenum for passage of the air from said input pipe therethrough, said downstream pipe presenting an open end beyond said plenum;

a diaphragm traversing said downstream pipe for passage of the air in said downstream plenum thereagainst;

means for closing said first downstream pipe open end;

at least one aperture in said closing means for passage of air therethrough;

a second pipe downstream of said input pipe and in air communication therewith, said second pipe including an aperture for passage of air entering said second pipe from said input pipe therethrough;

the forced air entering said input aperture vibrating said diaphragm to produce a sound, a regulation of a size of said input aperture, said second pipe aperture and said at least one aperture in said closing means influencing the aural characteristics of a sound produced by said vibrating of said diaphragm.

15. The amplifier as claimed in claim 14 further comprising a normally open aperture in said plenum, said aperture adapted for selectable closing by a finger of the user, said opening and closing influencing the aural characteristics of the sound produced by said vibrating of said downstream diaphragm.

16. An amplifier instrument comprising:

an input pipe presenting an input aperture adapted for entry of forced air produced by a user therein;

a first downstream plenum in communication with said input pipe;

an outlet tube in air communication with said input pipe and said first plenum, said outlet tube presenting an open end;

a downstream pipe in releasable communication with said first plenum for passage of air from said first plenum therethrough, said downstream pipe presenting a first open end for insertion into said first plenum and a second open end displaced from said first plenum;

a diaphragm traversing one of said ends of said downstream pipe for passage of air from said first plenum thereagainst;

a cap releasably secured to said second end of said downstream pipe;

at least one aperture in said cap end for passage of air therethrough;

a user-produced, forced air entering said input aperture vibrating said downstream diaphragm to produce a sound, a regulation of a size of said input aperture, said at least one aperture and said open end of said outlet tube influencing the aural characteristics of said sound produced by said vibrating diaphragm.

17. The amplifier as claimed in claim 16 wherein said diaphragm is stretched across said first open end of said downstream pipe, said cap forming a chamber between said diaphragm and said cap.

18. The amplifier as claimed in claim 16 wherein said diaphragm is stretched across said second end of said downstream pipe, said cap forming a chamber between said diaphragm and said cap.

19. The amplifier as claimed in claim 16 further comprising an aperture in said outlet tube for exhaust of air therethrough.

20. The amplifier as claimed in claim 16 further comprising a normally open aperture in said plenum, said aperture adapted for selectable closing by a finger of the user, said opening and closing influencing the aural characteristics of the sound produced by said vibrating of said downstream diaphragm.

21. The amplifier as claimed in claim 16 wherein said first end of said downstream pipe is beveled to present a first edge at said first end beyond a second edge of said first end, said first edge of said first end of said downstream pipe contacting an interior of said first plenum prior to said second edge to variably tension said diaphragm, whereby to influence a vibration of said diaphragm and said produced sound.

22. The amplifier as claimed in claim 19 wherein said plenum includes a tapered interior bore for reception of said downstream pipe therein, said tapered bore enhancing said contact of said first edge of said first end of said downstream pipe prior to said second edge contact to variably tension said diaphragm.

23. A voice amplifier instrument comprising:

an input chamber presenting an input aperture adapted for entry of user forced air therein;

a downstream plenum in communication with said input chamber;

a downstream housing presenting a chamber in communication with said plenum, said downstream housing chamber presenting a first end and a second open end extending beyond said plenum;

a diaphragm stretched across one of said ends in said downstream housing chamber;

a cap engaging said second end, said cap having a downstream end presenting a chamber between said diaphragm and said downstream cap end;

an aperture in said cap for communicating said diaphragm to air, said cap adjustable about said downstream housing chamber second open end, an adjustment of said cap positioning said cap downstream end and cap aperture at a desired position relative to said second open end of said downstream chamber and said diaphragm;

an outlet housing presenting a chamber, said outlet housing chamber presenting an outlet aperture for discharge of the user forced air therethrough, the user forced air entering said input aperture vibrating said diaphragm to produce a sound, a size of said input, outlet and cap apertures adapted for control by the fingers of a user whereby to influence the aural characteristics of sound produced by vibrating said diaphragm.

24. The amplifier as claimed in claim 21 further comprising a normally open aperture in said plenum, said aperture adapted for selectable closing by a finger of the user, said opening and closing influencing the aural characteristics of the sound produced by said vibrating of said downstream diaphragm.

25. A voice amplifier instrument comprising:

an input chamber presenting an input aperture adapted for entry of user forced air therein;

a downstream plenum in communication with said input chamber;

a downstream housing releasably engageable with said plenum, said downstream housing presenting a first end and a second open end extending beyond said plenum;

a diaphragm stretched across said first end of said downstream housing, an insertion of said downstream housing into said plenum tensioning said diaphragm spanning said first end of said downstream housing;

a cap engaging said second end, said cap having a downstream end presenting a chamber between said diaphragm and said cap end;

an aperture in said cap for communicating said diaphragm to air;

an outlet housing presenting a chamber, said outlet chamber presenting an outlet aperture for discharge of the user forced air therethrough, the user forced air entering said input aperture vibrating said downstream diaphragm to produce a sound, a size of said input, outlet and cap apertures adapted for control by the fingers of a user whereby to influence the aural characteristics of said sound by vibrating said diaphragm.

* * * * *

UNITED STATES PATENT AND TRADEMARK OFFICE

CERTIFICATE OF CORRECTION

PATENT NO. : 6,491,564 B1
DATED : December 10, 2002
INVENTOR(S) : Lauren F. Miller It is certified that error appears in the above-identified patent and that said Letters Patent is hereby corrected as shown below:

Column 3,
Line 1, delete "12" and substitute -- 10 --.
Line 50, delete "plenum 30" and substitute -- plenum 20 --.

Signed and Sealed this

Fifteenth Day of April, 2003

JAMES E. ROGAN
*Director of the United States Patent and Trademark Office*